US006408450B2

(12) United States Patent
Giaimis

(10) Patent No.: US 6,408,450 B2
(45) Date of Patent: Jun. 25, 2002

(54) DECORATIVE VASE AND TOILET COVER

(76) Inventor: John J. Giaimis, 753 Mill St., Apartment 14, Belleville, NJ (US) 07109

( * ) Notice: Subject to any disclaimer, the term of this patent is extended or adjusted under 35 U.S.C. 154(b) by 0 days.

(21) Appl. No.: 09/852,092

(22) Filed: May 10, 2001

Related U.S. Application Data

(60) Provisional application No. 60/203,523, filed on May 11, 2000.

(51) Int. Cl.[7] ..... E03D 1/00
(52) U.S. Cl. ..... 4/353; 4/661; 47/66.6
(58) Field of Search ..... 4/353, 661, 665; 47/41.01, 41.11, 66.6

(56) References Cited

U.S. PATENT DOCUMENTS

| | | | | | |
|---|---|---|---|---|---|
| 1,134,556 | A | * | 4/1915 | Recker | 4/661 |
| 1,935,779 | A | * | 11/1933 | Kemach | 4/665 |
| 3,696,448 | A | * | 10/1972 | Carfora | 4/665 |
| 4,174,589 | A | | 11/1979 | Daharsh | 47/66 |
| 4,307,923 | A | | 12/1981 | Raz | 312/237 |
| 4,364,132 | A | | 12/1982 | Robinson | 4/546 |
| 4,371,992 | A | | 2/1983 | Rivera | 4/353 |
| D270,936 | S | | 10/1983 | Everson | D23/49 |
| D299,049 | S | | 12/1988 | Reid | D23/294 |
| D299,166 | S | | 12/1988 | Reid | D23/294 |
| 4,932,084 | A | | 6/1990 | Hanson | 4/353 |
| D309,178 | S | | 7/1990 | Lowder, Sr. | D23/313 |
| D309,939 | S | | 8/1990 | Yvetot | D23/301 |
| 5,027,493 | A | | 7/1991 | Wood, Jr. et al. | 29/401.1 |
| 5,067,180 | A | | 11/1991 | Figeroid | 4/326 |
| 5,224,293 | A | | 7/1993 | Sarb | 47/66 |
| D351,463 | S | | 10/1994 | McCormick | D23/313 |
| 5,477,640 | A | * | 12/1995 | Holtkamp, Jr. | 47/66.6 |
| 5,586,409 | A | * | 12/1996 | Jamieson | 47/41.01 |
| 5,671,486 | A | | 9/1997 | Collavo | 4/353 |
| 5,784,998 | A | | 7/1998 | Manzer | 119/69.5 |
| 5,983,411 | A | | 11/1999 | Demoret | 4/353 |

* cited by examiner

*Primary Examiner*—Charles E. Phillips

(57) ABSTRACT

A decorative vase and toilet cover. The decorative vase and toilet cover is made up of a toilet cover with a raised aperture and a perforated basket being attached underneath the raised aperture. The perforated basket and raised aperture form a decorative vase, which can be easily broken down for removal and cleaning. The perforated basket is made of flexible thermoplastic material that is attached to the ceramic toilet cover by a pair of invertedly positioned ceramic buttons and slots. The holes on the perforated basket are approximately 20 mms. in diameter and are macroscopically designed to hold a set of flowers while allowing water to enter through the exterior of the perforated basket.

5 Claims, 5 Drawing Sheets

DECORATIVE VASE AND TOILET COVER

CROSS-REFERENCE TO RELATED APPLICATION

This application claims the benefit of U.S. Provisional Patent Application Ser. No. 60/203,523, filed May 11, 2000.

BACKGROUND OF THE INVENTION

1. Field of the Invention

The present invention relates to a decorative vase and toilet cover.

2. Description of Related Art

The bathroom is an often overlooked area of the house, especially when it comes to aesthetically pleasing furnishings. The area around the toilet is a particularly neglected area and is often reserved for air fresheners and deodorants. The related art reflects some unusual devices that serve as a combination toilet top and supplemental furnishing area. Other decorative combinations are also outlined for use around the bathroom as well.

U.S. Pat. No. 4,364,132 issued to Robinson outlines the use of a combination bathtub and aquarium. The perimeter areas around the bathtub serves as an aquarium and a water-tight chamber extending around the bathtub. A cover is also provides an access opening and there is also an aeration opening for the admission of air to water in the chamber and for servicing of the chamber. Fish can safely and comfortably be provided in the area around the bathtub without effecting the use of the bathtub.

U.S. Pat. No. 5,027,493 issued to Wood, Jr. et al. outlines the use of a decorative imitation wood surface tank cover. The cover includes a frame to surround an existing toilet tank, brackets for mounting the frame onto the tank and an actuator for flushing the toilet, which replaces the existing flush handle. The frame also includes a removable lid to permit access to the interior of the tank.

U.S. Pat. No. 4,174,589 issued to Daharsh outlines the use of a planter's box which can be set on top of the flush tank of a conventional commode in place of a standard commode top. The box is constructed to mount atop the commode tank to serve as a lid therefor. The box includes drainage ports with a mesh screen or replaceable filter to prevent the transfer of soil and material housing the plants and a small hand pump to drain and siphon water onto the plants.

U.S. Pat. No. 5,983,411 issued to Demoret outlines the use of an aquarium that is built into the toilet tank assembly. Specifically, an aquarium is situated around the perimeter of the toilet tank, whereby fish and other freshwater creatures can comfortably live. There is also a second embodiment of this invention where an aquarium tank is built on top of the toilet tank.

U.S. Pat. No. 5,671,486 issued to Collavo outlines the use of a decorative toilet tank cover which also allows a user to more easily monitor the toilet tank fill mechanism as well as being an aesthetic improvement to the top of the tank. Molded into the tank cover are a variety of figures, with the first figure receiving discharge from the float valve vent upon the flushing of the toilet. The fluid is then directed towards an opening in the second figure, which allows the fluid to drain into the drain standpipe of the toilet.

Japanese patent number JP 1996000357483 granted to Ito Kojiro outlines the use of a flower vase that is fitted on the top of the tank. The flower vase is used for aesthetic purposes only and does not have any functional use with the toilet. Like the flower base, all of these patents outline devices that add an aesthetic appeal to the bathroom. However, what is needed is a device that can not only have an aesthetic appeal, but can also serve some functional basis as well. That is what is really needed.

None of the above inventions and patents, taken either singly or in combination, is seen to describe the instant invention as claimed.

SUMMARY OF THE INVENTION

The invention is a decorative vase and toilet cover. The decorative vase and toilet cover is made up of a toilet cover with a raised aperture and a perforated basket being attached underneath the raised aperture. The perforated basket and raised aperture form a decorative vase, which can be easily broken down for removal and cleaning. The perforated basket is made of flexible thermoplastic material that is attached to the ceramic toilet cover by a pair of invertedly positioned ceramic buttons and slots. The holes on the perforated basket are approximately 20 mms. in diameter and are macroscopically designed to hold a set of flowers while allowing water to enter through the exterior of the perforated basket.

Accordingly, it is a principal object of the invention to provide an aesthetically pleasing toilet cover that also has the functional feature of being a self-watering decorative vase.

It is another object of the invention is to provide a self-watering decorative vase that is easy to clean and maintain.

It is a further object of the invention to provide a self-watering vase that is made of state of the art ceramic and thermoplastic materials.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
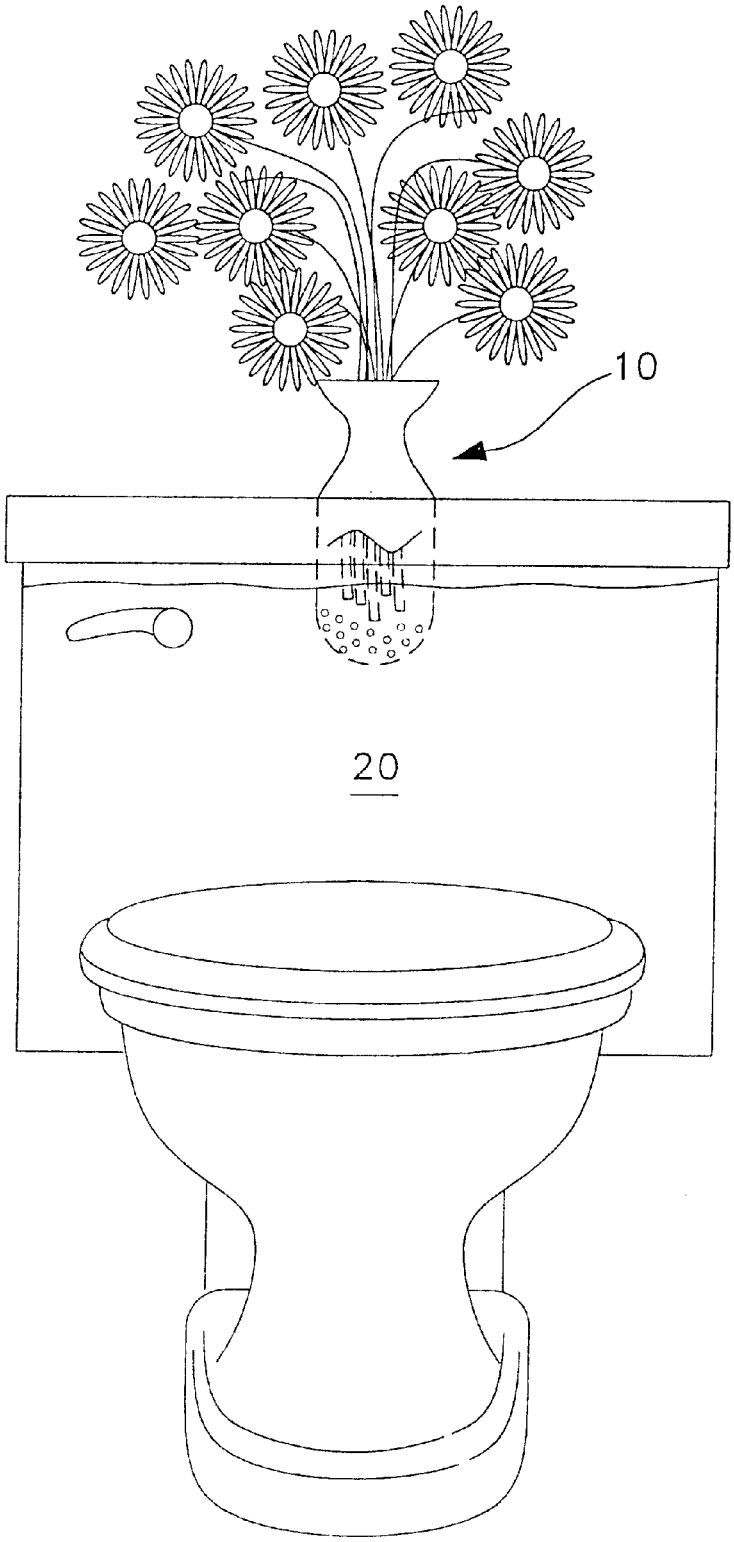
FIG. 1 is an environmental, perspective view of a decorative vase and toilet cover according to the present invention.

The present invention is a decorative vase and toilet cover 10 that is set on top of an existing toilet commode 20, as shown in FIG. 1.

Figure 2:
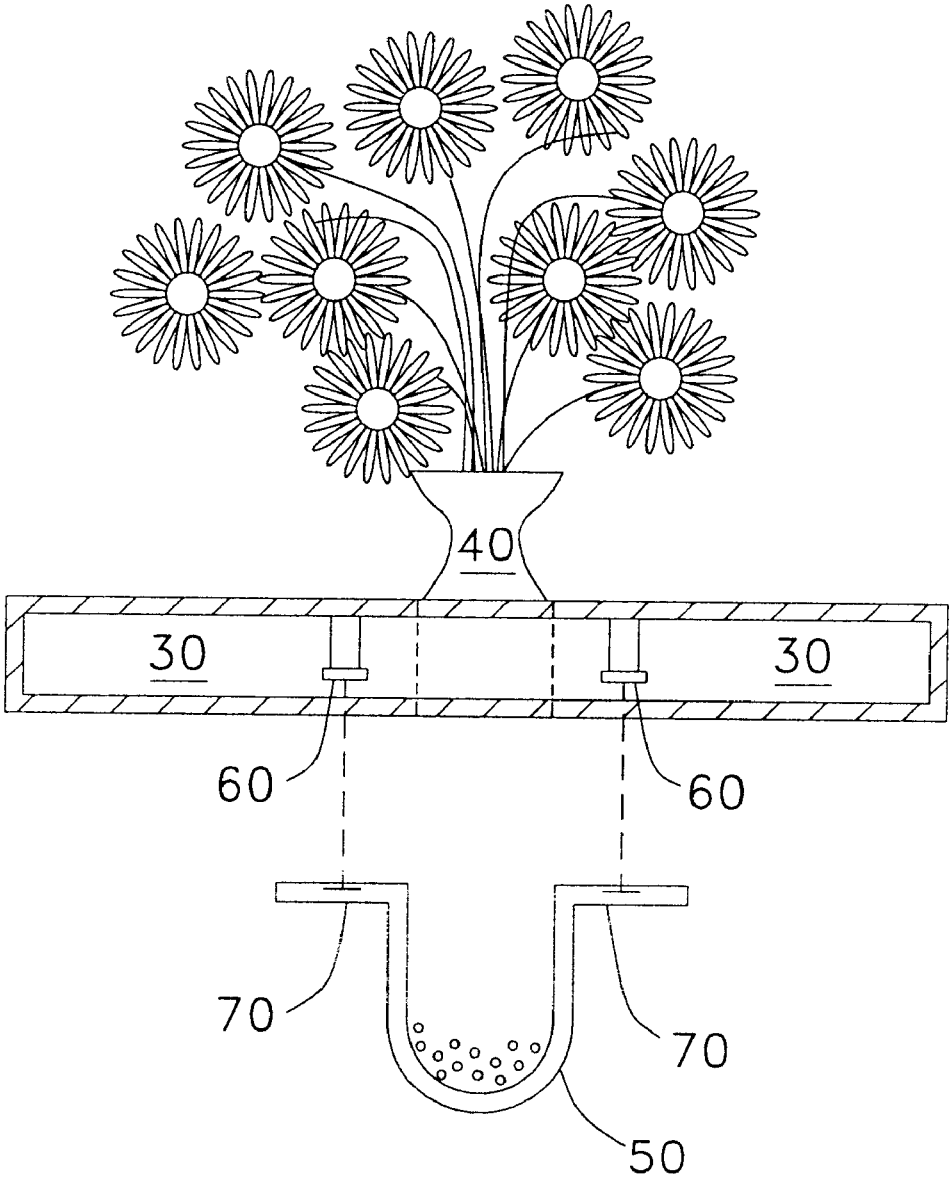
FIG. 2 is a part exploded, part sectional view of the decorative vase and toilet cover.

The decorative vase and toilet cover 10 are comprised of a toilet cover 30 that has a raised aperture 40 in the middle of the toilet cover 30 forming the top part of a vase, a perforated basket 50 that is set underneath the raised aperture 40 forming the bottom part of a vase and an attachment means for attaching the perforated basket 50 underneath the raised aperture 40. The raised aperture 40 is also removable and can be replaced with an ornamental replacement set of artificial flowers (See FIG. 5) to fill the remaining hole 45 created by removal of the raised aperture 40. This is shown in FIG. 2.

Figure 3:
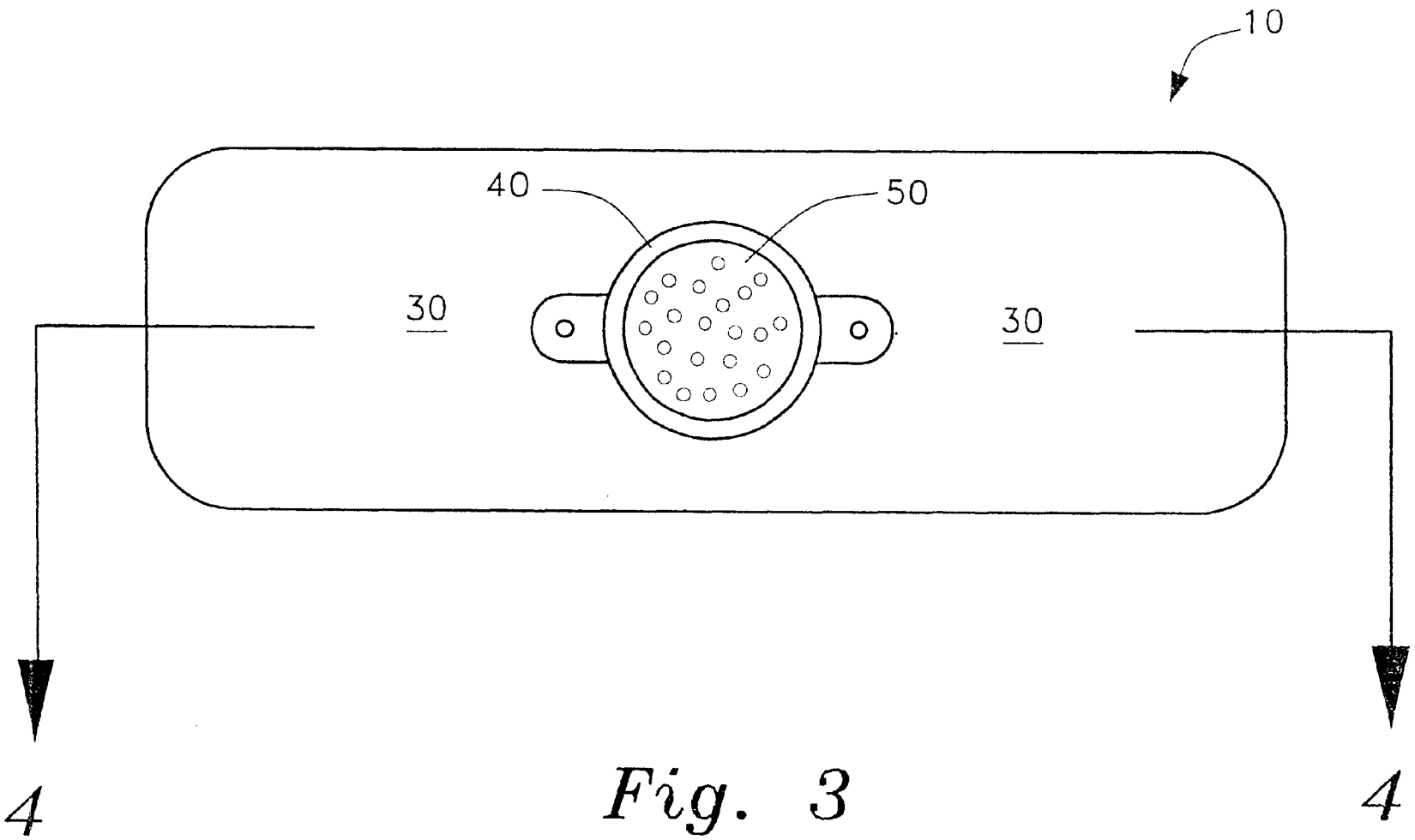
FIG. 3 is a top plan view of the decorative vase and toilet cover.

The attachment means are ceramic buttons 60 on the underside of the toilet cover 30 that are inserted through the slots 70 that are provided on the upper sides of the perforated basket 50. These ceramic buttons 60 are designed to allow a user to manually slide the slots 70 on the perforated basket 50 over and through the ceramic buttons 60. The perforated basket 50 is hung invertedly underneath the toilet cover 30 in such a fashion that water from the toilet commode 20 is always exposed to the perforated basket 50. This is shown in FIG. 3.

The decorative vase and toilet cover 10 is made of ceramic material, with the exception of the perforated basket 50 which is made of a flexible thermoplastic material, such as polypropylene. The perforated basket 50 is macroscopically designed with holes that are approximately 20 mms. in diameter. A small variance of hole size can be expected by the perforated basket 50, but this variance should not effect the performance of the decorative vase and toilet cover 10.

Figure 4:
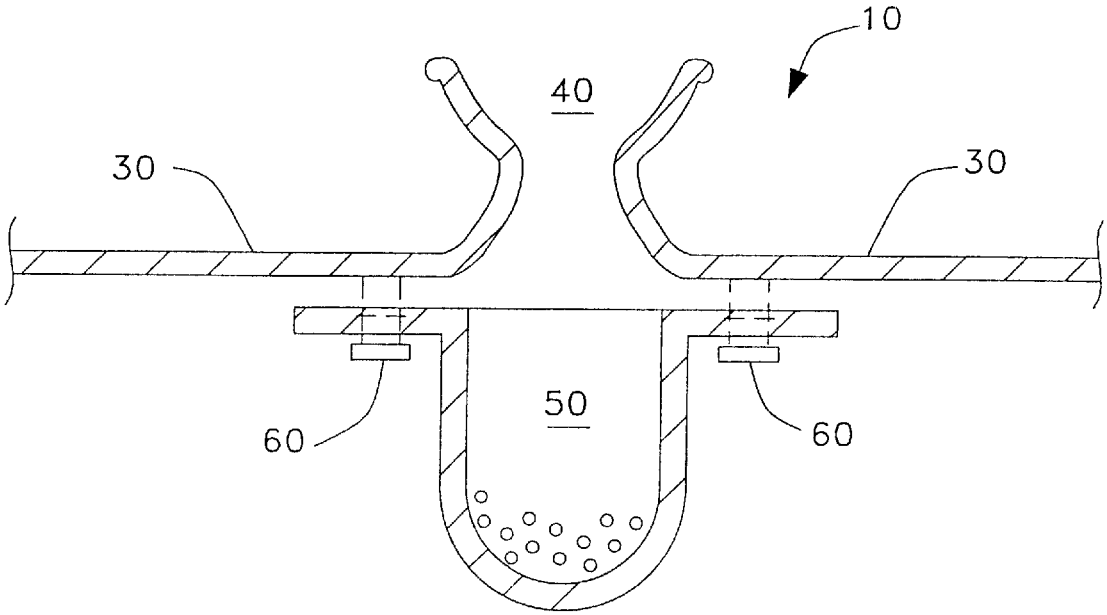
FIG. 4 is a cross-sectional view taken along lines 4—4 of FIG. 3.

These holes are not designed for filtering materials, such as those found in filter paper, which are much larger in comparison with openings that are on the order of magnitude of one millionth of a meter (1 micron). These holes are designed to hold the bottom of a set of flowers that could be placed in the raised aperture 40, while allowing water from the toilet commode 20 to come in through the holes on the outside of the perforated basket 50. An illustration of the perforated basket 50 and vase and toilet cover 10 is shown in FIG. 4.

Figure 5:
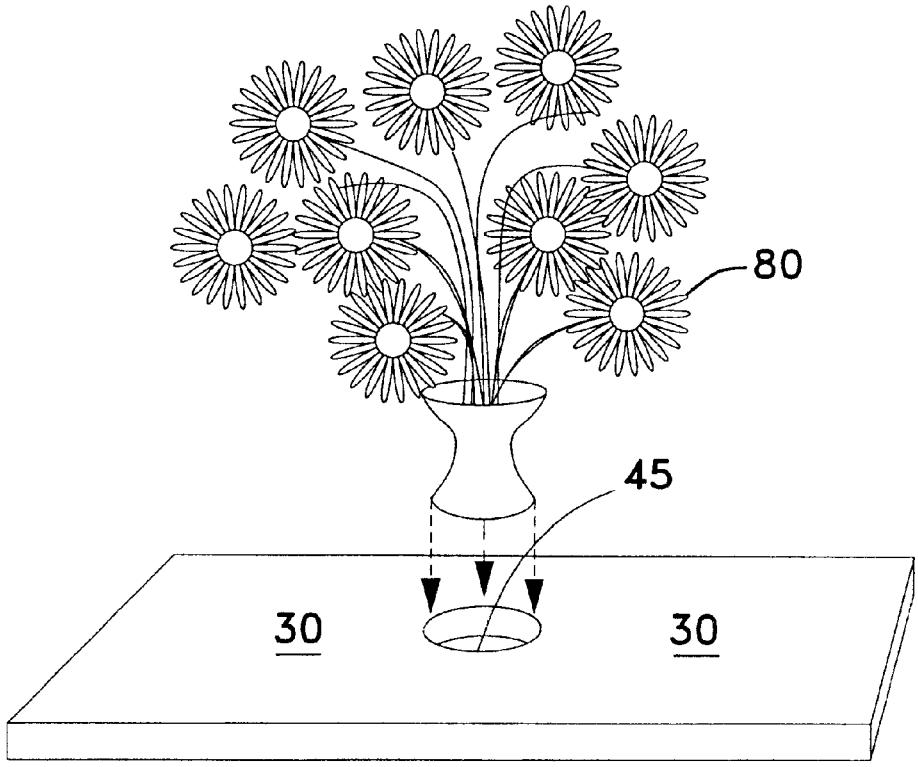
FIG. 5 is an exploded view of the second embodiment of a decorative vase and toilet cover according to the present invention.

FIG. 5 depicts a second embodiment of the invention. The second embodiment involves making the raised aperture 40 removable from the toilet cover 30. An ornamental set of replacement artificial flowers 80 is used to fill the remaining aperture 45 created by removal of the raised aperture 40. The ornamental set of replacement flowers 80 can be used to fill-in the aperture 45 created by the removal of the raised aperture 40 while old flowers are being replenished.

Use of the decorative vase and toilet cover 10 is uncomplicated. A user can simply take the decorative vase and toilet cover 10 and replace it with the toilet cover 10 that is provided on a standard sized toilet. The amount of water used by the toilet commode 20 should be adjusted so that the water line of the toilet commode 20 always provides some water through the perforated basket 50. The decorative vase and toilet cover 10 is designed to hold as much as one half dozen flowers and the perforated basket 50 can be easily removed and cleaned for easy maintenance.

It is to be understood that the present invention is not limited to the sole embodiment described above, but encompasses any and all embodiments within the scope of the following claims.

I claim:

1. A decorative vase and toilet cover that is set on top of an existing toilet commode, comprising:

a toilet cover that has a raised aperture, forming a top part of a vase;

a perforated basket that is set underneath the raised aperture forming a bottom part of a vase, said basket having a plurality of holes designed to hold the bottom of a set of flowers; and an attaching means for attaching the perforated basket underneath the raised aperture.

2. The decorative vase and toilet cover according to claim 1, wherein said toilet cover is made of ceramic material.

3. The decorative vase and toilet cover according to claim 1, wherein said perforated basket is made of thermoplastic material.

4. The decorative vase and toilet cover according to claim 1, wherein said attachment means are ceramic buttons on the underside of the toilet cover that are inserted through the slots that are provided on the upper sides of the perforated basket.

5. The decorative vase and toilet cover according to claim 1, wherein the raised aperture is removable and replaced with an ornamental replacement.

* * * * *